US011371459B2

(12) United States Patent
Ohata

(10) Patent No.: US 11,371,459 B2
(45) Date of Patent: Jun. 28, 2022

(54) CONTROL DEVICE FOR INTERNAL COMBUSTION ENGINE

(71) Applicant: Hitachi Astemo, Ltd., Hitachinaka (JP)

(72) Inventor: Eiichirou Ohata, Hitachinaka (JP)

(73) Assignee: Hitachi Astemo, Ltd., Hitachinaka (JP)

( * ) Notice: Subject to any disclaimer, the term of this patent is extended or adjusted under 35 U.S.C. 154(b) by 0 days.

(21) Appl. No.: 17/294,910

(22) PCT Filed: Oct. 29, 2019

(86) PCT No.: PCT/JP2019/042247
§ 371 (c)(1),
(2) Date: May 18, 2021

(87) PCT Pub. No.: WO2020/110555
PCT Pub. Date: Jun. 4, 2020

(65) Prior Publication Data

US 2022/0003185 A1 Jan. 6, 2022

(30) Foreign Application Priority Data

Nov. 29, 2018 (JP) ..... JP2018-223998

(51) Int. Cl.
*F02D 41/38* (2006.01)
*F02D 35/02* (2006.01)

(52) U.S. Cl.
CPC ..... *F02D 41/3845* (2013.01); *F02D 35/023* (2013.01); *F02D 2200/024* (2013.01); *F02D 2200/0602* (2013.01)

(58) Field of Classification Search
CPC ..... F02D 41/3845; F02D 35/023; F02D 2200/024; F02D 2200/0602
See application file for complete search history.

(56) References Cited

U.S. PATENT DOCUMENTS 4,967,711 A * 11/1990 Morikawa ..... F02D 35/023 123/478
5,722,371 A * 3/1998 Denz ..... F02D 41/068 123/406.42

(Continued)

FOREIGN PATENT DOCUMENTS

JP 10-339201 A 12/1998
JP 2014-139415 A 7/2014

(Continued)

OTHER PUBLICATIONS

International Search Report (PCT/ISA/210) issued in PCT Application No. PCT/JP2019/042247 dated Feb. 10, 2020 with English translation (five (5) pages).

(Continued)

*Primary Examiner* — Joseph J Dallo
(74) *Attorney, Agent, or Firm* — Crowell & Moring LLP

(57) ABSTRACT

To appropriately adjust a pressure of a fuel according to a valve closing force of a fuel injection valve. To that end, a control device for an internal combustion engine includes a fuel pressure control unit that controls a pressure of a fuel supplied to a fuel injection valve that injects the fuel to an internal combustion engine. The fuel injection valve includes a plunger rod that is a valve body, a solenoid coil that is a drive unit for driving the plunger rod, and an orifice cup in which a fuel injection hole that is opened and closed according to drive of the plunger rod is formed. A cylinder pressure sensor that detects an in-cylinder pressure is attached to the internal combustion engine. The fuel pressure control unit controls the pressure of the fuel based on a pressure difference ΔP between the in-cylinder pressure detected by the cylinder pressure sensor before the plunger rod is separated from a seat portion of the orifice cup which is a valve seat and the in-cylinder pressure detected by the (Continued)

cylinder pressure sensor when the plunger rod is separated from the seat portion of the orifice cup.

8 Claims, 10 Drawing Sheets

(56) References Cited

U.S. PATENT DOCUMENTS

| | | | | |
|---|---|---|---|---|
| 6,446,610 | B1 * | 9/2002 | Mazet | F02D 41/3818 123/357 |
| 2009/0084348 | A1 * | 4/2009 | Batenburg | F02D 19/024 123/294 |
| 2015/0275802 | A1 * | 10/2015 | Takamiya | F02B 37/001 60/602 |
| 2016/0138511 | A1 * | 5/2016 | Toyohara | F02D 41/2467 123/478 |
| 2016/0208731 | A1 * | 7/2016 | Onder | F02D 35/023 |
| 2016/0333812 | A1 | 11/2016 | Shimatsu et al. | |
| 2018/0283306 | A1 * | 10/2018 | Kusakabe | F02D 41/402 |
| 2019/0218986 | A1 * | 7/2019 | Yamaguchi | F02D 41/0275 |
| 2019/0360423 | A1 * | 11/2019 | Parotto | F02D 41/3082 |

FOREIGN PATENT DOCUMENTS

| | | | |
|---|---|---|---|
| JP | 2014-163919 | A | 9/2014 |
| JP | 2016-217180 | A | 12/2016 |
| WO | WO 2014/050999 | A1 | 4/2014 |

OTHER PUBLICATIONS

Japanese-language Written Opinion (PCT/ISA/237) issued in PCT Application No. PCT/JP2019/042247 dated Feb. 10, 2020 (three (3) pages).

* cited by examiner

WAVEFORM OF IN-CYLINDER PRESSURE P (NORMAL COMBUSTION STATE)

WAVEFORM OF IN-CYLINDER PRESSURE P (FLAME EXTINGUISHING STATE)

CONTROL DEVICE FOR INTERNAL COMBUSTION ENGINE

TECHNICAL FIELD

The present invention relates to a control device for an internal combustion engine.

BACKGROUND ART

In recent years, in order to improve fuel efficiency of vehicles, it is necessary to reduce power consumption of vehicles. One of the means is to reduce a pressure of a fuel sent from a fuel tank to a fuel injection valve. That is, a valve closing force of the fuel injection valve is determined by the sum of an elastic force of an elastic body such as a spring that biases a valve body of the fuel injection valve in a valve closing direction and the pressure of the fuel. Accordingly, when the pressure of the fuel is reduced, driving power of the fuel injection valve can be reduced, which is effective in reducing the power consumption. Further, a supply pressure or friction of a fuel pump that sends a fuel from the fuel tank to the fuel injection valve can be reduced, and a seating noise generated at the time of valve closing can be also reduced by reducing the valve closing force of the fuel injection valve.

However, when the pressure of the fuel is reduced too much, the oil-tightness of the fuel injection valve decreases, and thus, there is a concern that fuel leakage may occur. Therefore, it is necessary to appropriately adjust the pressure of the fuel according to the valve closing force so that the valve closing force is not less than a valve closing force by which the oil-tightness of the fuel injection valve can be secured.

PTL 1 is known regarding a reduction of a drive current when a fuel injection valve is opened or closed. PTL 1 discloses a technique of detecting a collision of a movable core driven when the fuel injection valve is opened or closed by an in-cylinder pressure sensor that detects a pressure inside a cylinder in which the fuel injection valve is installed, and reducing a drive current according to a detection result.

CITATION LIST

Patent Literature

PTL 1: JP 2016-217180 A

SUMMARY OF INVENTION

Technical Problem

According to the technique disclosed in PTL 1, it is possible to detect the opening or closing of the fuel injection valve. However, it is not possible to appropriately adjust a pressure of a fuel according to a valve closing force of the fuel injection valve.

Therefore, the present invention is made inconsideration of the above-mentioned problems, and an object of the present invention is to appropriately adjust the pressure of the fuel according to the valve closing force of the fuel injection valve.

Solution to Problem

According to an aspect of the present invention, there is provided a control device for an internal combustion engine including: a fuel pressure control unit that controls a pressure of a fuel supplied to a fuel injection valve that injects the fuel to an internal combustion engine, in which the fuel injection valve has a valve body, a drive unit that drives the valve body, and a fuel injection hole that is opened or closed according to drive of the valve body, a cylinder pressure sensor that detects an in-cylinder pressure which is a pressure in a combustion chamber of the internal combustion engine is attached to the internal combustion engine, and the fuel pressure control unit controls the pressure of the fuel based on a pressure difference between the in-cylinder pressure detected by the cylinder pressure sensor before the valve body is separated from a valve seat and the in-cylinder pressure detected by the cylinder pressure sensor when the valve body is separated from the valve seat.

Advantageous Effects of Invention

According to the present invention, a pressure of a fuel can be appropriately adjusted according to a valve closing force of a fuel injection valve.

DESCRIPTION OF EMBODIMENTS

Hereinafter, a control device 1 which is one mode of a control device for an internal combustion engine according to an embodiment of the present invention will be described. In this embodiment, a case where the control device 1 controls a 4-cylinder internal combustion engine 100 will be described as an example.

Hereinafter, in the embodiment, a combination of some configurations or all configurations of the internal combustion engine 100 and some configurations or all configurations of the control device 1 is referred to as the control device 1 of the internal combustion engine 100.

[Internal Combustion Engine]

Figure 1:
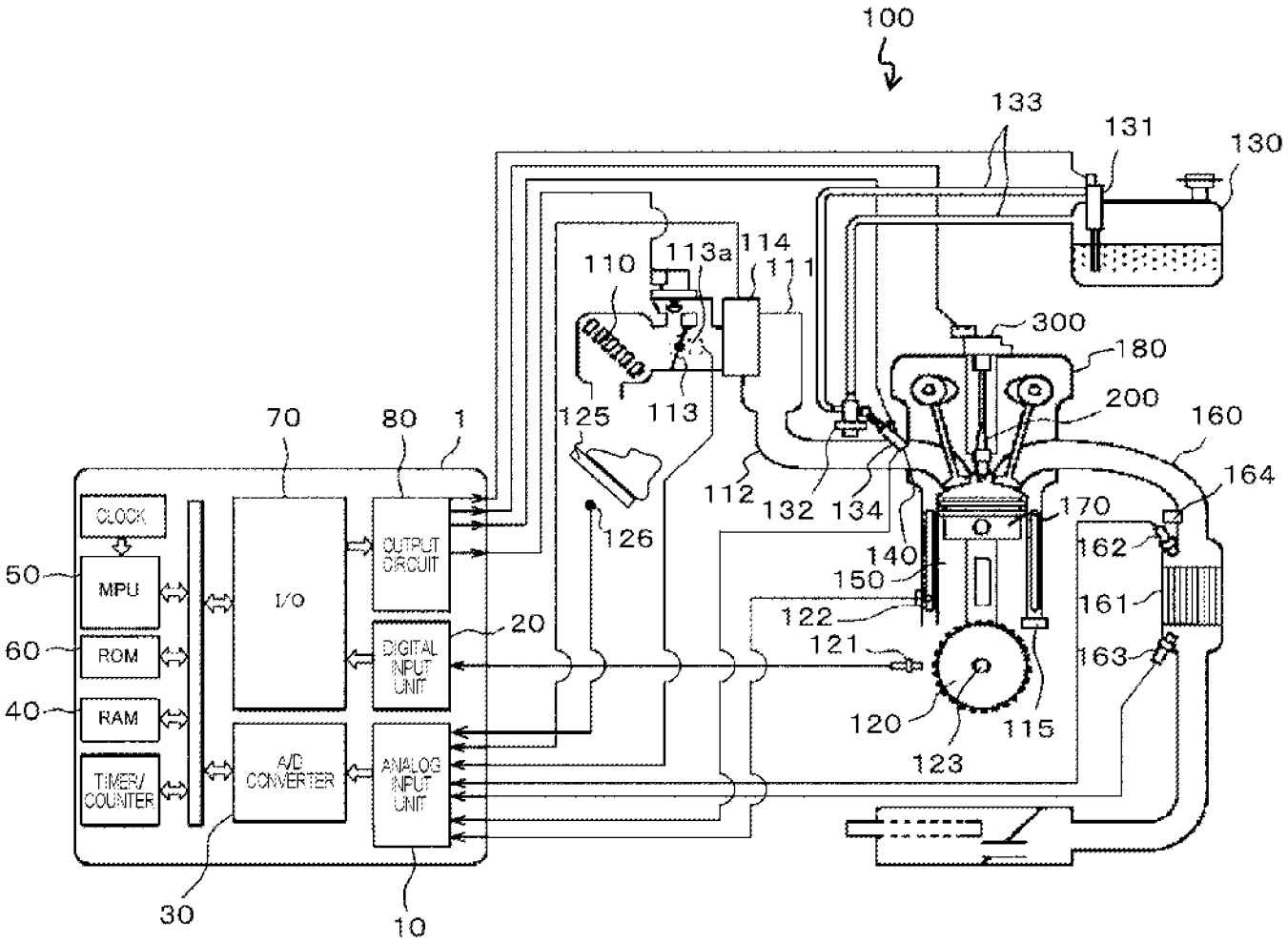
FIG. 1 is a diagram illustrating main configurations of an internal combustion engine and a control device for an internal combustion engine according to an embodiment.

FIG. 1 is a diagram illustrating main configurations of the internal combustion engine 100 and the control device 1 that controls the internal combustion engine 100.

In the internal combustion engine 100, air sucked from the outside flows through an air cleaner 110, an intake pipe 111, and an intake manifold 112, and flows into each cylinder 150. An amount of air flowing into each cylinder 150 is adjusted by a throttle valve 113, and the amount of air adjusted by the throttle valve 113 is measured by a flow rate sensor 114. Moreover, a pressure of the air flowing into each cylinder 150 is measured by an intake pressure sensor 116 (refer to FIG. 3) provided in the intake manifold 112.

The throttle valve 113 is provided with a throttle opening sensor 113*a* that detects an opening of a throttle. Opening information of the throttle valve 113 detected by the throttle opening sensor 113*a* is output to the control device (Electronic Control Unit: ECU) 1.

As the throttle valve 113, an electronic throttle valve driven by an electric motor is used. However, any valve may be used as long as a flow rate of air can be appropriately adjusted.

A temperature of a gas flowing into each cylinder 150 is detected by an intake air temperature sensor 115.

A crank angle sensor 121 is provided radially outside a ring gear 120 attached to a crankshaft 123. The crank angle sensor 121 detects a rotation angle of the crankshaft 123. In the embodiment, for example, the crank angle sensor 121 detects the rotation angle of the crankshaft 123 every 10° and each combustion cycle.

A water temperature sensor 122 is provided in a water jacket (not illustrated) of the internal combustion engine 100. The water temperature sensor 122 detects a temperature of cooling water of the internal combustion engine 100.

Further, the vehicle includes an accelerator position sensor (APS) 126 that detects a displacement amount (depression amount) of an accelerator pedal 125. The accelerator position sensor 126 detects a torque required by a driver. The required torque of the driver detected by the accelerator position sensor 126 is output to the control device 1 described later. The control device 1 controls the throttle valve 113 based on this required torque.

A fuel stored in a fuel tank 130 is sucked by a feed pump 131 and then passes through a fuel pipe 133 and is guided to a pressurizing pump 132. The pressurizing pump 132 pressurizes the fuel supplied from the feed pump 131 to adjust the fuel pressure to a predetermined fuel pressure, and sends the fuel to a fuel injection valve (injector) 134 installed in each cylinder 150 via the fuel pipe 133. As a result of the pressure adjustment by the pressurizing pump 132, an excess fuel is returned to the fuel tank 130 via a return pipe (not illustrated).

The fuel injection valve 134 injects the fuel pressurized by the pressurizing pump 132 into each cylinder 150. Although the fuel injection valve 134 is attached to the intake manifold 112 in FIG. 1, in actual, the fuel injection valve 134 is attached to a cylinder head 180 of the internal combustion engine 100 so that the fuel can be injected into the cylinder 150. The fuel pipe 133 between the pressurizing pump 132 and the fuel injection valve 134 is provided with a fuel pressure sensor 135 (refer to FIG. 5) that measures an injection pressure of the fuel at the fuel injection valve 134.

A cylinder pressure sensor (CPS, also referred to as an in-cylinder pressure sensor) 140 is provided in each cylinder 150 of the internal combustion engine 100. The cylinder pressure sensor 140 detects a pressure (combustion pressure) in the cylinder 150. In the embodiment, the cylinder pressure sensor 140 is provided at a tip of the fuel injection valve 134.

The cylinder pressure sensor 140 is a vibration detection type sensor that detects the combustion pressure by measuring a mechanical vibration of the internal combustion engine 100. In the embodiment, the cylinder pressure sensor 140 is a non-resonant type vibration detection sensor, and can detect vibrations of the internal combustion engine 100 over a wide frequency band.

An exhaust manifold 160 which discharges a gas (exhaust gas) after combustion to the outside of the cylinder 150 is attached to each cylinder 150. A three-way catalyst 161 is provided on an exhaust side of the exhaust manifold 160, and exhaust gas is discharged from the cylinder 150 to the exhaust manifold 160. The exhaust gas passes through the exhaust manifold 160, is purified by the three-way catalyst 161, and is then discharged to the atmosphere.

An upstream-side air-fuel ratio sensor 162 and an exhaust temperature sensor 164 are provided on an upstream side of the three-way catalyst 161. The upstream-side air-fuel ratio sensor 162 continuously detects an air-fuel ratio of an exhaust gas discharged from each cylinder 150. The exhaust temperature sensor 164 measures a temperature of the exhaust gas discharged from the cylinder 150.

Moreover, a downstream-side air-fuel ratio sensor 163 is provided on a downstream side of the three-way catalyst 161. The downstream-side air-fuel ratio sensor 163 outputs a switch-like detection signal in the vicinity of a theoretical air-fuel ratio. In the embodiment, for example, the downstream-side air-fuel ratio sensor 163 is an O2 sensor.

Further, a spark plug 200 is provided in an upper portion of each cylinder 150. Due to discharge (ignition) of the spark plug 200, a spark is ignited in a mixture of air and a fuel in the cylinder 150, an explosion occurs in the cylinder 150, and a piston 170 is pushed down. When the piston 170 is pushed down, the crankshaft 123 rotates.

An ignition coil 300 which generates electric energy (voltage) supplied to the spark plug 200 is connected to the spark plug 200. Discharge is generated between a center electrode and an outer electrode of the spark plug 200 by a voltage generated in the ignition coil 300.

Output signals from various sensors such as the throttle opening sensor 113*a*, the flow rate sensor 114, the crank angle sensor 121, the accelerator position sensor 126, the water temperature sensor 122, the fuel pressure sensor 135, the cylinder pressure sensor 140, or the like described above are output to the control device 1. The control device 1 detects an operation state of the internal combustion engine 100 based on the output signals from the various sensors, and controls an amount (target air amount) of air sent into the cylinder 150, a fuel injection amount, an ignition timing of the spark plug 200, an amount of pressurization on a fuel by the pressurizing pump 132, or the like.

The target air amount calculated by the control device 1 is converted from the throttle opening (target throttle opening) into an electronic throttle drive signal, and is output to an electric motor (not illustrated) that drives the throttle valve 113. Further, the ignition timing calculated by the control device 1 is output to the ignition coil 300 as an ignition signal converted into an energization start angle and an energization angle, and the fuel is discharged (ignited) by the spark plug 200 based on the ignition signal.

[Hardware Configuration of Control Device]

Next, an overall configuration of hardware of the control device 1 will be described.

As illustrated in FIG. 1, the control device 1 includes an analog input unit 10, a digital input unit 20, an Analog/Digital (A/D) converter 30, a Random Access Memory (RAM) 40, and a Micro-Processing Unit (MPU) 50, a Read Only Memory (ROM) 60, an Input/Output (I/O) port 70, and an output circuit 80.

Analog output signals from various sensors such as the throttle opening sensor 113*a*, the flow rate sensor 114, the accelerator position sensor 126, the upstream-side air-fuel ratio sensor 162, the downstream-side air-fuel ratio sensor 163, the cylinder pressure sensor 140, the water temperature sensor 122, and the fuel pressure sensor 135 are input to the analog input unit 10.

The A/D converter 30 is connected to the analog input unit 10. The analog output signals from the various sensors input to the analog input unit 10 are subjected to signal processing such as noise removal, converted into digital signals by the A/D converter 30, and stored in the RAM 40.

The digital output signal from the crank angle sensor 121 is input to the digital input unit 20.

An I/O port 70 is connected to the digital input unit 20, and the digital output signal input to the digital input unit 20 is stored in the RAM 40 via the I/O port 70.

Each output signal stored in the RAM 40 is arithmetically processed by the MPU 50.

The MPU 50 executes a control program (not illustrated) stored in the ROM 60 to arithmetically process the output signal stored in the RAM 40 according to a control program. The MPU 50 calculates a control value which defines an operation amount of each actuator (for example, the throttle valve 113, the pressurizing pump 132, the spark plug 200, or the like) which drives the internal combustion engine 100 according to the control program, and temporarily stores the control value in the RAM 40.

The control value, which is stored in the RAM 40 and defines the operation amount of the actuator, is output to the output circuit 80 via the I/O port 70.

Each function of a fuel injection control unit 82 (refer to FIG. 2) that controls the fuel injection valve 134, an ignition control unit 83 (refer to FIG. 2) that controls a voltage applied to the spark plug 200, and a fuel pressure control unit 90 (refer to FIG. 2) that controls the pressurizing pump 132 is provided in the output circuit 80.

[Functional Block of Control Device]

Next, a functional configuration of the control device 1 according to the embodiment will be described.

Figure 2:
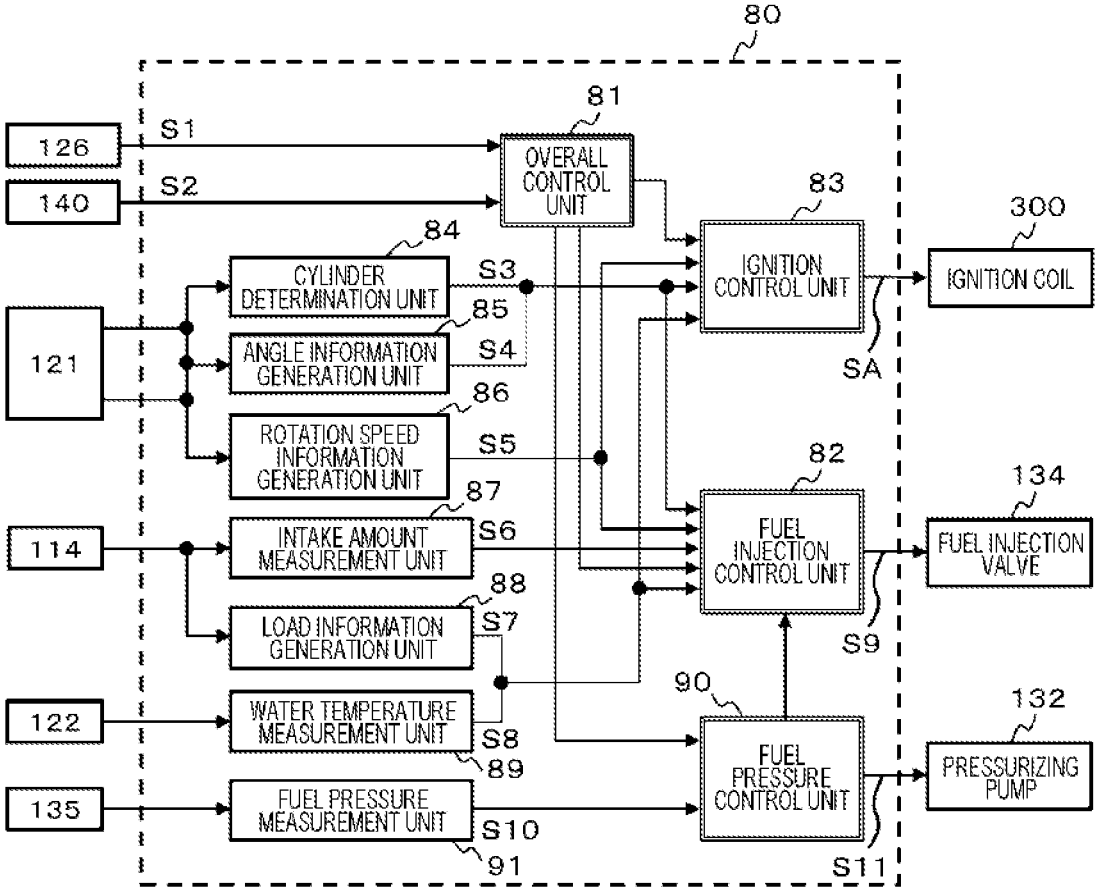
FIG. 2 is a functional block diagram illustrating a functional configuration of the control device according to the embodiment.

FIG. 2 is a functional block diagram illustrating the functional configuration of the control device 1 according to the embodiment.

For example, each function of the control device 1 is realized by the output circuit 80 when the MPU 50 executes the control program stored in the ROM 60.

As illustrated in FIG. 2, the output circuit 80 of the control device 1 according to the embodiment includes an overall control unit 81, the fuel injection control unit 82, the ignition control unit 83, and the fuel pressure control unit 90.

The overall control unit 81 is connected to the accelerator position sensor 126 and the cylinder pressure sensor 140 (CPS), and receives a required torque (acceleration signal S1) from the accelerator position sensor 126 and an output signal S2 from the cylinder pressure sensor 140.

The overall control unit 81 controls the fuel injection control unit 82, the ignition control unit 83, and the fuel pressure control unit 90 as a whole based on the required torque (acceleration signal S1) from the accelerator position sensor 126 and the output signal S2 from the cylinder pressure sensor 140.

In the embodiment, at least combustion pressure (vibration: output signal S2) information from the cylinder pressure sensor 140 is input to the overall control unit 81, and the overall control unit 81 detects the combustion pressure or occurrence of knocking based on this information.

The fuel injection control unit 82 is connected to a cylinder determination unit 84 which determines each cylinder 150 of the internal combustion engine 100, an angle information generation unit 85 which measures a crank angle of the crankshaft 123, and a rotation speed information generation unit 86 which measures an engine speed, and receives cylinder discrimination information S3 from the cylinder determination unit 84, crank angle information S4 from the angle information generation unit 85, and engine speed information S5 from the rotation speed information generation unit 86.

Further, the fuel injection control unit 82 is connected to an intake amount measurement unit 87 which measures an intake amount of the air sucked into the cylinder 150, a load information generation unit 88 which measures an engine load, and a water temperature measurement unit 89 which measures a temperature of engine cooling water, and receives intake air amount information S6 from the intake amount measurement unit 87, engine load information S7 from the load information generation unit 88, and cooling water temperature information S8 from the water temperature measurement unit 89.

The fuel injection control unit 82 calculates an injection amount and an injection time of fuel to be injected from the fuel injection valve 134 based on the received information, and outputs a valve opening control signal S9 for controlling the fuel injection valve 134 based on the calculated fuel injection amount and injection time.

The ignition control unit 83 is connected to the cylinder determination unit 84, the angle information generation unit 85, the rotation speed information generation unit 86, the load information generation unit 88, and the water temperature measurement unit 89 in addition to the overall control unit 81, and receives each information from these.

The ignition control unit 83 calculates an amount of current (energization angle) for energizing a primary coil (not illustrated) of the ignition coil 300, an energization start time, and a time (ignition time) when the current for energizing the primary coil is cut off, based on the received information.

The ignition control unit 83 outputs an ignition signal SA to the primary coil of the ignition coil 300 based on the calculated energization angle, energization start time, and ignition time to perform a discharge control (ignition control) by the spark plug 200.

Further, combustion pressure (in-cylinder pressure) information and knocking information from the overall control unit 81 are input to the ignition control unit 83.

The ignition control unit 83 calculates a correction value of the ignition timing by MBT control based on the combustion pressure information, and calculates a retard angle correction value based on the knocking information. The ignition control unit 83 performs a Minimum advance for the Best Torque (MBT) control or a retard angle control when knocking occurs based on these calculation results.

The fuel pressure control unit 90 is connected to a fuel pressure measurement unit 91 that measures the fuel pressure in addition to the overall control unit 81, and receives the combustion pressure (in-cylinder pressure) information from the overall control unit 81 and fuel pressure information S10 from the fuel pressure measurement unit 91.

The fuel pressure control unit 90 calculates the pressure of the fuel injected from the fuel injection valve 134 based on each received information, and outputs fuel pressure control information S11 to the pressurizing pump 132 to control the pressure of the fuel to be supplied to the fuel injection valve 134.

Further, the pressure of the fuel calculated by the fuel pressure control unit 90 is output to the fuel injection control unit 82. A calculation result of the fuel pressure output from the fuel pressure control unit 90 to the fuel injection control unit 82 is used to control the fuel injection valve 134 in the fuel injection control unit 82.

[Main Configurations of Internal Combustion Engine]

Next, a main configuration of the internal combustion engine 100 to which the control device 1 according to the embodiment is applied will be described. For example, the internal combustion engine 100 is an in-cylinder injection type gasoline engine for vehicles.

Figure 3:
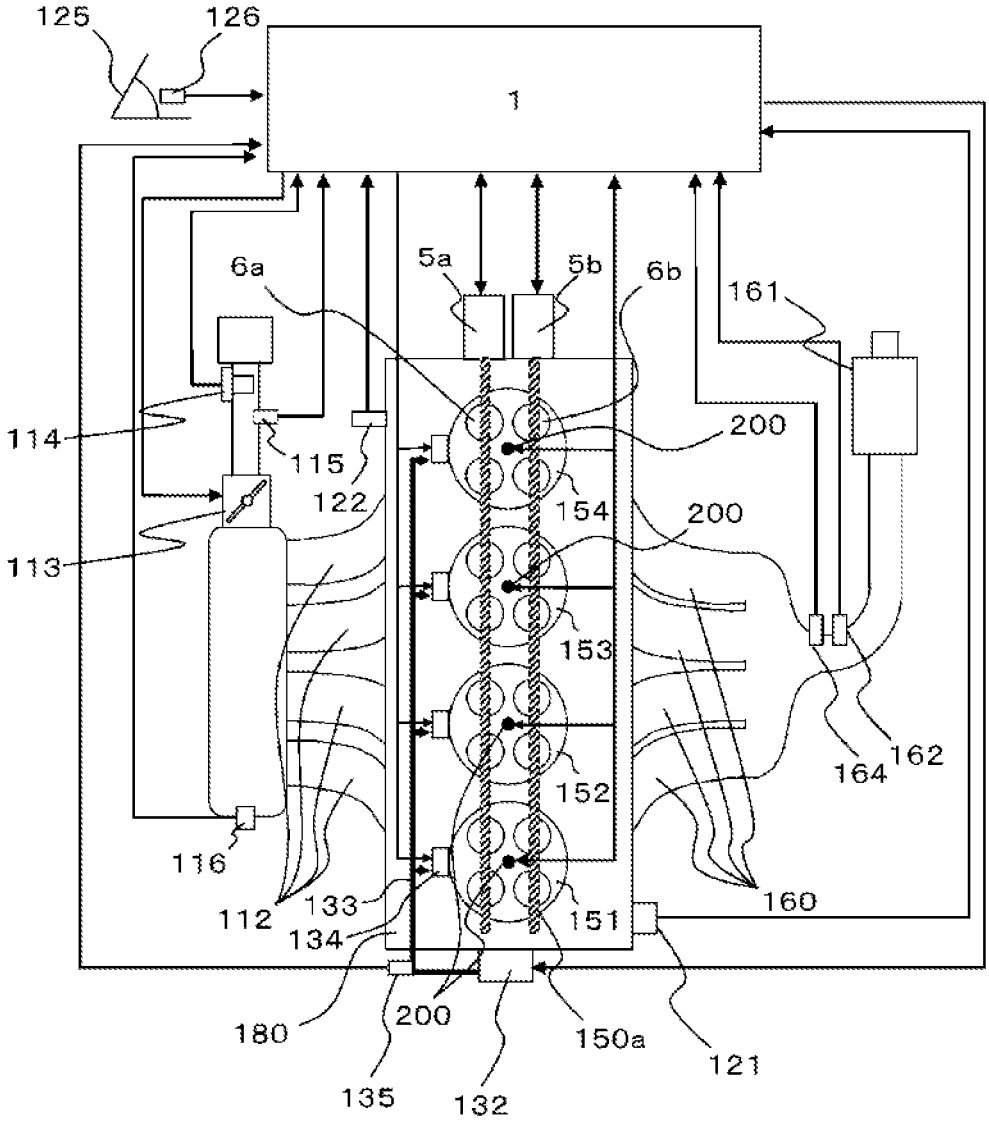
FIG. 3 is a schematic diagram illustrating a main configuration of an internal combustion engine to which the control device is applied.
Figure 4:
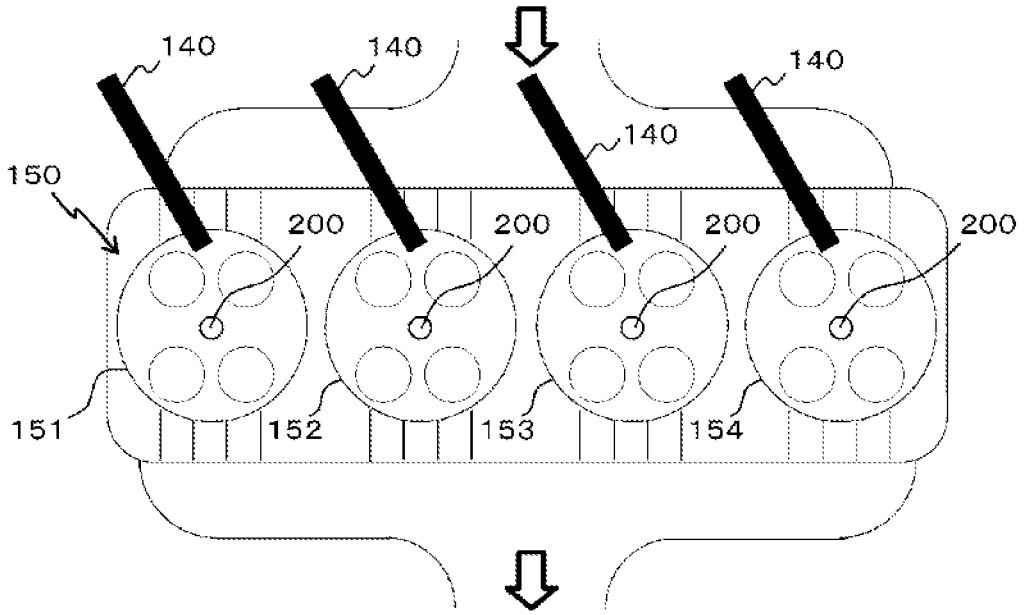
FIG. 4 is a plan view illustrating an arrangement of cylinders.

FIG. 3 is a schematic diagram illustrating the main configuration of the internal combustion engine 100 to which the control device 1 is applied. FIG. 4 is a plan view illustrating an arrangement of each cylinder 150.

As illustrated in FIG. 3, a case where the internal combustion engine 100 of the embodiment is an in-line 4-cylinder gasoline engine for a vehicle that implements spark ignition type combustion will be described as an example.

As illustrated in FIGS. 3 and 4, in the internal combustion engine 100, a first cylinder 151, a second cylinder 152, a third cylinder 153, and a fourth cylinder 154 are provided in series with a cylinder block (not illustrated). Hereinafter, when the first cylinder 151 to the fourth cylinder 154 are not particularly distinguished, they are simply referred to as a cylinder 150.

As illustrated in FIGS. 3 and 4, the spark plug 200 and the cylinder pressure sensor 140 are attached to the inside of the combustion chamber 150*a* of each cylinder 150. In the combustion chamber 150*a* of each cylinder 150, the rotation angle of the crankshaft 123 has a cycle of 180°, and ignition and combustion are performed by the spark plug 200, respectively. When the internal combustion engine 100 has an in-line 4-cylinder, combustion in each cylinder 150 is performed in the order of the first cylinder 151, the third cylinder 153, the fourth cylinder 154, and the second cylinder 152.

As illustrated in FIG. 3, a cylinder head 180 is provided above each cylinder 150. An intake camshaft 5*a* that operates an intake valve 6*a* that adjusts intake of the air-fuel mixture (mixture of air and fuel) into the cylinder 150 and an exhaust camshaft 5*b* that operates an exhaust valve 6*b* that adjusts exhaust of an exhaust gas from the inside of the cylinder 150 are provided in the cylinder head 180.

As illustrated in FIG. 3, a high-pressure fuel pressurized by the pressurizing pump 132 is supplied to the fuel injection valve 134 attached to each cylinder 150 through the fuel pipe 133, and is injected from the fuel injection valve 134 into each cylinder 150.

[Pressurizing Pump]

Next, the pressurizing pump 132 that supplies a high-pressure fuel to the fuel injection valve 134 will be described.

Figure 5:
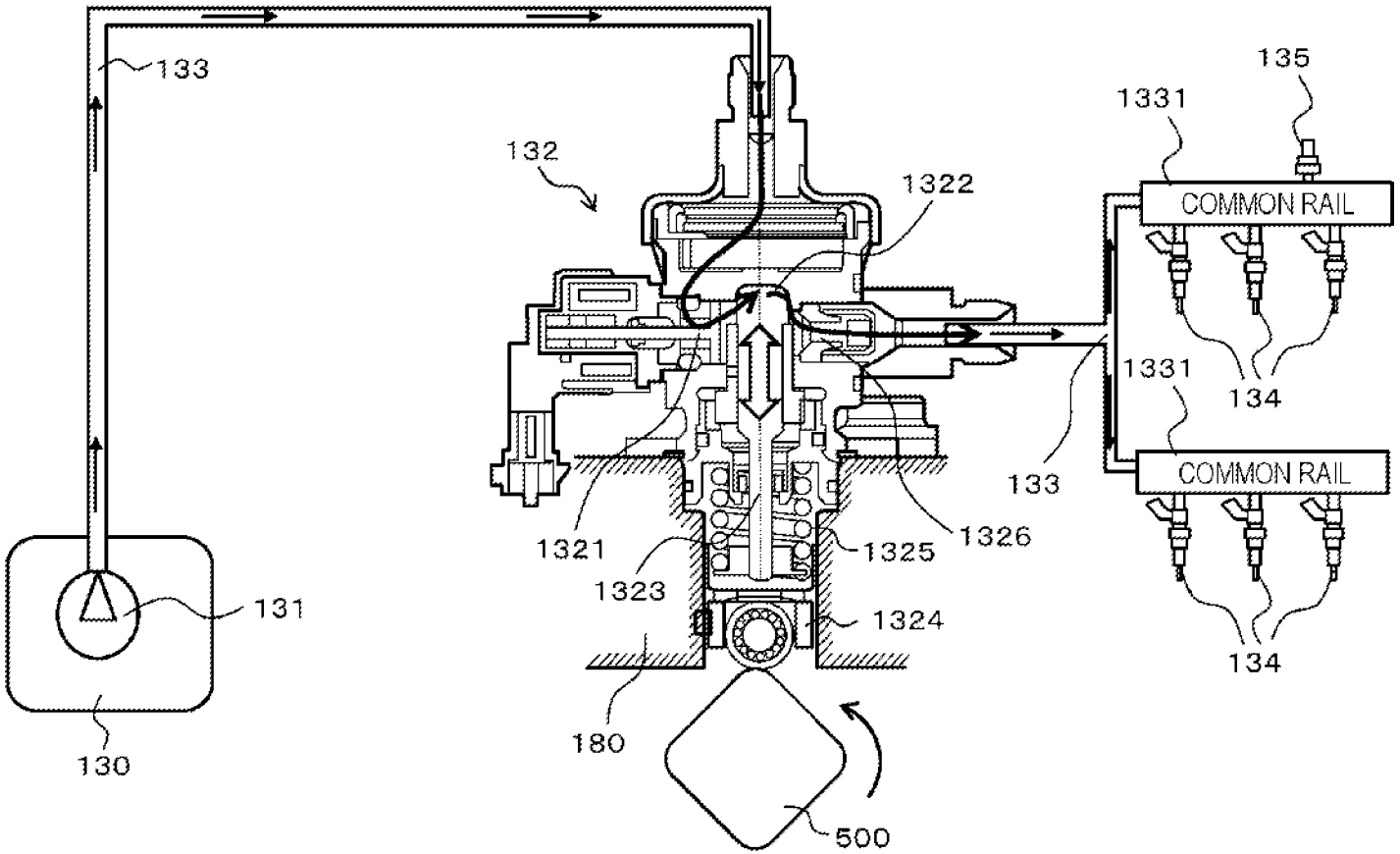
FIG. 5 is a diagram illustrating a pressurizing pump.

FIG. 5 is a diagram illustrating the pressurizing pump 132.

As illustrated in FIG. 5, the pressurizing pump 132 is connected to the feed pump 131 and the fuel injection valve 134 installed in the fuel tank 130 by the fuel pipe 133, respectively. The pressurizing pump 132 is connected to a pump drive cam 500 that is rotationally driven in conjunction with the crankshaft 123 of the internal combustion engine 100, and is driven by the rotational drive of the pump drive cam 500. As a result, a low-pressure fuel supplied from the feed pump 131 is pressurized, and a high-pressure fuel after pressurization is sent to the fuel injection valve 134.

The pressurizing pump 132 has a suction valve 1321, a pressurizing chamber 1322, a plunger 1323, a tappet 1324, a pressing spring 1325, and a discharge valve 1326. The plunger 1323 is pressed against the pump drive cam 500 via the tappet 1324 by an elastic force of the pressing spring 1325. The pump drive cam 500 has a quadrangular shape in a cross-sectional view, and is rotationally driven in conjunction with the crankshaft 123 of the internal combustion engine 100. A volume of the pressurizing chamber 1322 is changed as the plunger 1323 moves up and down according to the rotational drive of the pump drive cam 500.

The fuel sucked from the fuel tank 130 by the feed pump 131 is supplied to the pressurizing pump 132 through a route illustrated by arrows in FIG. 5. The pressurizing pump 132 opens the suction valve 1321 to introduce the fuel into the pressurizing chamber 1322, and then closes the suction valve 1321 at a predetermined timing. In this state, the plunger 1323 is raised according to the rotational drive of the pump drive cam 500, the volume of the pressurizing chamber 1322 decreases, and thus, the fuel pressure in the pressurizing chamber 1322 increases.

The pressurizing pump 132 opens the discharge valve 1326 at a timing when the fuel pressure in the pressurizing chamber 1322 reaches a predetermined target value. Accordingly, the high-pressure fuel pressurized by the pressurizing pump 132 is sent to the fuel pipe 133 on the fuel injection valve 134 side and supplied to each fuel injection valve 134 through a common rail 1331 to which the plurality of fuel injection valves 134 are attached.

A pressurizing step of the pressurizing pump 132 is a process from closing the suction valve 1311 to opening the discharge valve 1326. During this period, a drive torque of the pump drive cam 500 is required in order to raise the plunger 1323 by rotationally driving the pump drive cam 500. Since the pump drive cam 500 is interlocked with the crankshaft 123 of the internal combustion engine 100, the drive torque of the pump drive cam 500 for operating the pressurizing pump 132 becomes a reaction force against a combustion torque (engine torque) generated by the combustion of the internal combustion engine 100. The sum of the drive torque of the pump drive cam 500 and the combustion torque is output to the outside as the engine torque of the internal combustion engine 100.

Here, in the embodiment, the pump drive cam 500 rotates once (360°) every time the crankshaft 123 rotates twice (720°). Therefore, every time the crankshaft 123 rotates half a turn (180°), the drive torque of the pump drive cam 500 acts as a load on the crankshaft 123.

In the embodiment, the pump drive cam 500 has a quadrangular shape which is a basic shape in cross-sectional view, but the shape of the pump drive cam 500 can be appropriately determined according to the number of cylinders of the internal combustion engine 100. In this case, it is desirable that the number of vertices (for example, four vertices of a quadrangle) of the pump drive cam 500 is the same as the number of cylinders. For example, in the case of a 6-cylinder internal combustion engine, two triangular-shaped pump drive cams 500 may be used, and the total number of vertices of the pump drive cams 500 may be the same as the number of cylinders. Further, in the case of an 8-cylinder internal combustion engine, two square-shaped pump drive cams 500 may be used, and the total number of vertices of the pump drive cams 500 may be the same as the number of cylinders.

Further, in the embodiment, the control device 1 controls the suction valve 1321 of the pressurizing pump 132 so that the suction valve 1321 is closed after the position of the piston 170 in the cylinder 150 exceeds a top dead center. Therefore, an attachment position of the pump drive cam 500 around a rotation shaft is set so that the plunger 1323 is operated in an upward direction after the piston 170 exceeds the top dead center. Therefore, the drive torque of the pump drive cam 500 becomes maximum after the piston 170 exceeds the top dead center.

[Change in In-Cylinder Pressure]

Next, a change in the in-cylinder pressure (combustion pressure) Pin the cylinder 150 according to a combustion state in the internal combustion engine 100 will be described.

Figure 6:
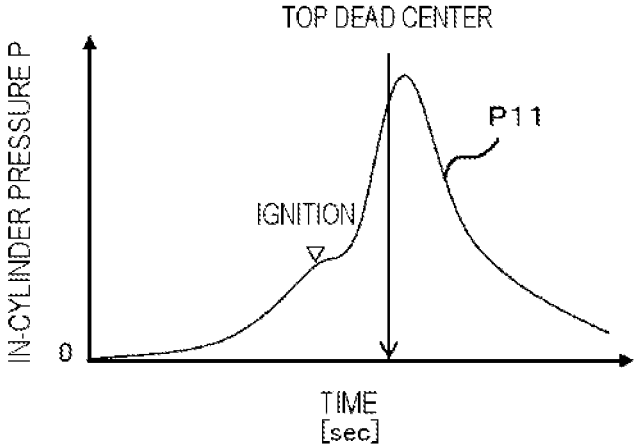
FIG. 6 is an example of a waveform of an in-cylinder pressure detected by a cylinder pressure sensor.
Figure 7:
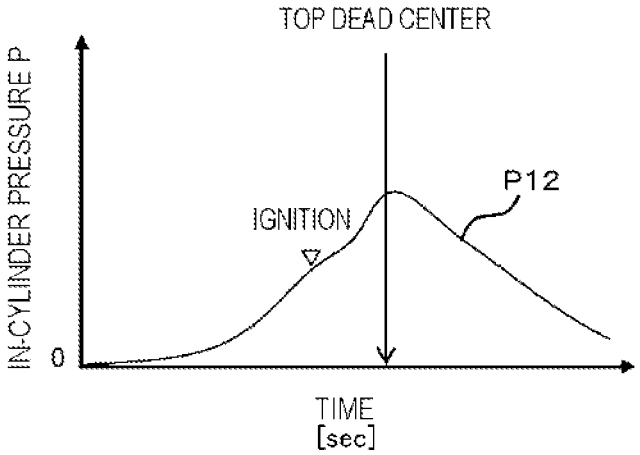
FIG. 7 is an example of the waveform of the in-cylinder pressure detected by the cylinder pressure sensor.

FIGS. 6 and 7 illustrate examples of waveforms of the in-cylinder pressure detected by the cylinder pressure sensor 140, respectively. A waveform P11 in FIG. 6 illustrates an example of a change in the in-cylinder pressure P in a normal combustion state. A waveform P12 in FIG. 7 illustrates an example of the change in the in-cylinder pressure P in a flame extinguishing state. In FIGS. 6 and 7, a horizontal axis indicates a time and a vertical axis indicates the in-cylinder pressure P.

As illustrated in the waveform P11 of FIG. 6, the in-cylinder pressure P of the cylinder 150 in the normal combustion state becomes a maximum value after the top dead center. Meanwhile, as illustrated in the waveform P12 of FIG. 7, the maximum value of the in-cylinder pressure P of the cylinder 150 in the flame extinguishing state becomes smaller than that in the normal state, and a timing at which the maximum value reaches becomes close to the top dead center. The flame extinguishing state is a state in which combustion starts after ignition when the air-fuel ratio in the cylinder 150 is thin, and then flame extinguishing occurs during combustion.

[Fuel Injection Valve and Cylinder Pressure Sensor]

Next, the fuel injection valve 134 and the cylinder pressure sensor 140 will be described.

Figure 8:
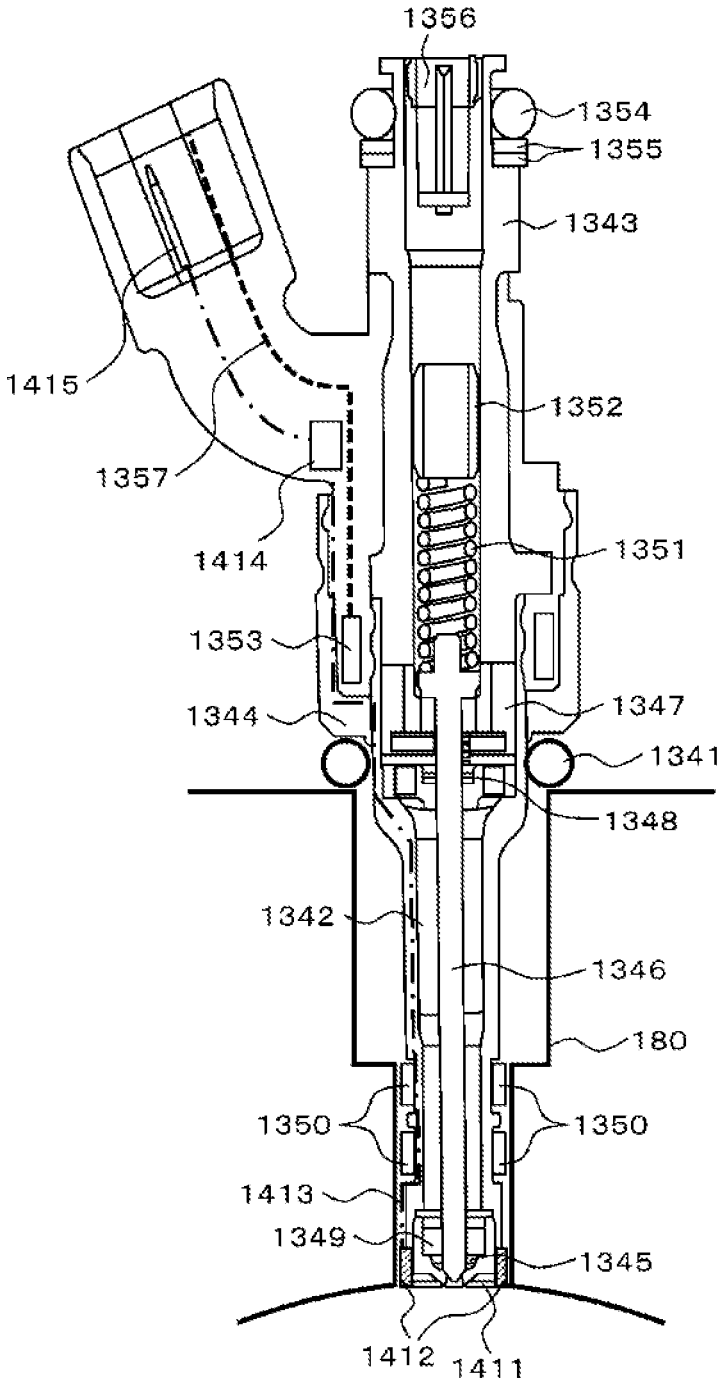
FIG. 8 is a cross-sectional view of a fuel injection valve and the cylinder pressure sensor.

FIG. 8 is a cross-sectional view of the fuel injection valve 134 and the cylinder pressure sensor 140. In FIG. 8, in a tubular fuel injection valve 134 that is inserted into the cylinder head 180 from the outside of the internal combustion engine 100 toward the inside of each cylinder 150 and has the cylinder pressure sensor 140 disposed at a tip thereof, a structure of an axial cross section of the fuel injection valve 134 cut along a central axis extending in an insertion direction thereof is illustrated.

The fuel injection valve 134 includes a nozzle holder 1342, a core 1343, a housing 1344, an orifice cup 1345, a plunger rod 1346, an anchor 1347, an upstream rod guide 1348, a downstream rod guide 1349, a spring 1351, an adjuster pin 1352, and a solenoid coil 1353.

The nozzle holder 1342 houses the orifice cup 1345, the plunger rod 1346, the anchor 1347, the upstream rod guide 1348, and the downstream rod guide 1349, and secures them at their respective positions. The core 1343 houses the spring 1351 and the adjuster pin 1352 and secures them at their respective positions. The housing 1344 houses the solenoid coil 1353.

As illustrated in FIG. 8, the fuel injection valve 134 is attached to the cylinder head 180 via a tolerance ring 1341. The tolerance ring 1341 abuts against a seating surface of the cylinder head 180 and absorbs an eccentric load when the fuel injection valve 134 is inserted at an angle with respect to the cylinder head 180.

A common rail 1331 (refer to FIG. 5) is located on an opposite side of the cylinder 150. The fuel injection valve 134 is inserted into an attachment hole provided in the common rail 1331 via the O-ring 1354. When the O-ring 1354 comes into contact with an inner peripheral portion of the attachment hole of the common rail 1331, an internal space and an external space of the attachment hole are sealed.

The backup ring 1355 supports the O-ring 1354 on an upper end surface of the core 103.

A high-pressure fuel from the common rail 1331 flows into the fuel injection valve 134 in a state where foreign matters are removed by a filter 1356 attached to an upper end side of the fuel injection valve 134, passes through a fuel passage formed in the fuel injection valve 134, and then reaches the orifice cup 1345. A plurality of fuel injection holes are formed in the orifice cup 1345, and the fuel is discharged from the fuel injection holes into the cylinder 150 according to an operation of the plunger rod 1346 acting as a valve body.

The plunger rod 1346 is housed in the nozzle holder 1342 in a state of being slidable in the axial direction via the anchor 1347. An outer periphery of the plunger rod 1346 is supported by an upstream rod guide 1348 fixed to the nozzle holder 1342 and a downstream rod guide 1349 fixed to the orifice cup 1345. A chip seal 1350 is attached to an outer peripheral portion on the downstream side of the nozzle holder 1342, and thus, seals an internal space and an external space of the cylinder head 180.

The spring 1351 is located between the plunger rod 1346 and the adjuster pin 1352. A position of an upper end portion of the spring 1351 is constrained by the adjuster pin 1352. When the spring 1351 presses the plunger rod 1346 against a seat portion of the orifice cup 1345, the fuel injection valve 134 is closed. At this time, the plunger rod 1346 acts as a valve body, and the seat portion of the orifice cup 1345 acts as a valve seat.

The solenoid coil 1353 is located radially outward of anchor 1347. The solenoid coil 1353 is energized with a drive current from a drive circuit (not illustrated) provided outside the fuel injection valve 134 via a wire 1357. Accordingly, the core 1343 is excited to generate a magnetic attraction, and the anchor 1347 is pulled upward in the axial direction. Along with this, a convex portion on an outer diameter side of the plunger rod 1346 engages with the anchor 1347, and thus, the plunger rod 1346 is pulled upward in the axial direction, and the plunger rod 1346 is separated from the seat portion of the orifice cup 1345. Therefore, a plurality of fuel injection holes formed in the orifice cup 1345 are opened, and the high-pressure fuel supplied from the pressurizing pump 132 via the common rail 1331 is injected into the cylinder 150. That is, the solenoid coil 1353 acts as a drive unit for driving the plunger rod 1346 which is the valve body. The fuel injection valve 134 is operated by opening and closing the fuel injection hole of the orifice cup 1345 according to the drive of the plunger rod 1346 by the solenoid coil 1353.

The cylinder pressure sensor 140 is provided at the tip of the nozzle holder 1342 of the fuel injection valve 134, and has a diaphragm 1411 and a pressure detection element 1412.

When the fuel injection valve 134 is inserted into the cylinder head 180, the diaphragm 1411 of the cylinder pressure sensor 140 is disposed closer to the combustion chamber of the cylinder 150 than the fuel injection hole formed in the orifice cup 1345 in the fuel injection valve 134. Due to this disposition, the diaphragm 1411 is bent and deformed according to the pressure (in-cylinder pressure) in the cylinder 150, and thus, the diaphragm 1411 acts as a pressure receiving unit. An amount of deformation of the diaphragm 1411 according to the in-cylinder pressure is detected as an amount of strain of the pressure detection element 1412 disposed around the diaphragm 1411, and an electric signal corresponding to the amount of strain is output from the pressure detection element 1412. That is, the pressure detection element 1412 acts as a pressure detecting unit that detects the pressure received by the diaphragm 1411 as the in-cylinder pressure. For example, the pressure detection element 1412 is constituted by a piezoelectric element. Accordingly, it possible to detect the in-cylinder pressure (combustion pressure) of the cylinder 150 over a wide temperature range.

The electric signal from the pressure detection element 1412 is transmitted to a charge amplifier 1414 integrally formed with the fuel injection valve 134 via a wire 1413. The charge amplifier 1414 integrates the electric signal from the pressure detection element 1412 and generates the output signal S2 corresponding to the magnitude of the in-cylinder pressure. The output signal S2 from the charge amplifier 1414 is transmitted to the analog input unit 10 (refer to FIG. 1) of the control device 1 via a terminal 1415. The terminal 1415 and the wire 1413 are integrally molded with synthetic resin together with the wire 1357 described above for energizing the drive current to the solenoid coil 1353.

In order to reduce an influence of a noise, it is preferable that the charge amplifier 1414 is disposed as close as possible to the pressure detection element 1412. Alternatively, by substituting the integration function of the charge amplifier 1414 with the processor in the control device 1, the charge amplifier 1414 may be omitted to reduce the cost.

[Control Method of Fuel Pressure]

Next, a method of controlling the fuel pressure according to the embodiment will be described.

Figure 9:
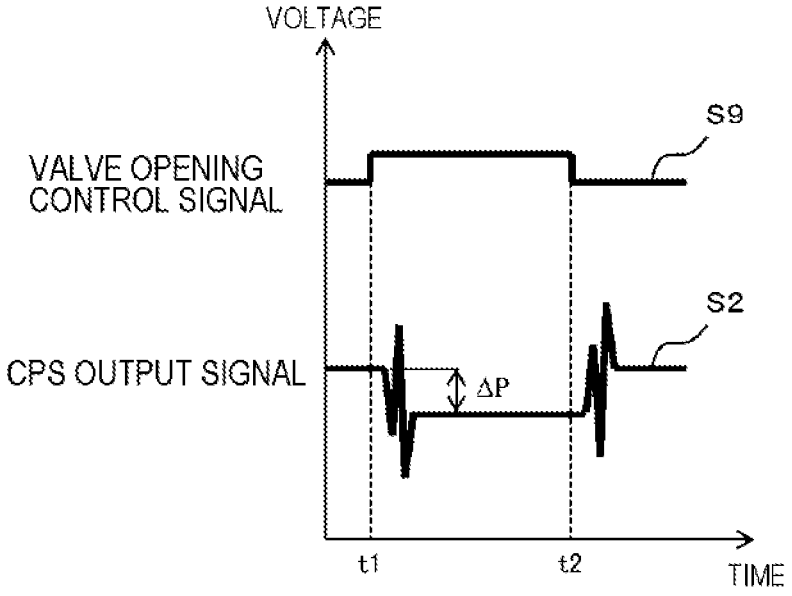
FIG. 9 is a diagram illustrating an example of waveforms of a valve opening control signal and an output signal from the cylinder pressure sensor.

FIG. 9 is a diagram illustrating an example of waveforms of the valve opening control signal S9 output from the fuel injection control unit 82 to the fuel injection valve 134 and the output signal S2 from the cylinder pressure sensor 140.

As illustrated in FIG. 9, the output signal S2 from the cylinder pressure sensor 140 is changed according to the valve opening control signal S9. That is, when an energization pulse of the valve opening control signal S9 is turned on at a time t1, a valve opening instruction is given to the fuel injection valve 134, and fuel injection starts. At this time, the plunger rod 1346 is pulled upward in the axial direction by the solenoid coil 1353 as described above. When a movement of the plunger rod 1346 reaches a predetermined lift, the anchor 1347 and the core 1343 collide with each other. A mechanical vibration generated in the fuel injection valve 134 due to this collision is transmitted to the cylinder pressure sensor 140, and is detected by the cylinder pressure sensor 140 as a change in the in-cylinder pressure. As a result, as illustrated in FIG. 9, in the output signal S2 from the cylinder pressure sensor 140, an amplitude fluctuates after the time t1.

Further, when the energization pulse of the valve opening control signal S9 is turned off at a time t2, a valve closing instruction is given to the fuel injection valve 134, and the fuel injection is stopped. In this case, when a drive current to the solenoid coil 1353 is stopped, the plunger rod 1346 is pushed back by the spring 1351, and the plunger rod 1346 collides with the seat portion of the orifice cup 1345. The mechanical vibration generated in the fuel injection valve 134 due to this collision is also transmitted to the cylinder pressure sensor 140 in the same manner as the mechanical vibration at the time of valve opening, and is detected by the cylinder pressure sensor 140 as a change in the in-cylinder pressure. As a result, as illustrated in FIG. 9, in the output signal S2 from the cylinder pressure sensor 140, the amplitude fluctuates after the time t2.

Further, in the output signal S2 from the cylinder pressure sensor 140, the voltage is displaced according to the presence or absence of the valve closing force before and after the amplitude fluctuation at the time of opening and closing the valve. The displacement of the voltage indicates a pressure difference ΔP between a pressure in the cylinder 150 when the fuel injection valve 134 is in a closed state, that is, an in-cylinder pressure detected by the cylinder pressure sensor 140 before the plunger rod 1346, which is the valve body, is separated from the seat portion of the orifice cup 1345, which is the valve seat, and a pressure in the cylinder 150 when the fuel injection valve 134 is in an open state, that is, the in-cylinder pressure detected by the cylinder pressure sensor 140 when the plunger rod 1346 is separated from the seat portion of the orifice cup 1345.

The valve closing force of the fuel injection valve 134 is determined by the sum of a force with which the spring 1351 presses the plunger rod 1346 against the seat portion of the orifice cup 1345 and a fuel pressure supplied from the pressurizing pump 132 to the fuel injection valve 134. When the fuel injection valve 134 is in the closed state, the cylinder pressure sensor 140 detects the pressure in the cylinder 150 plus the valve closing force as the in-cylinder pressure. Meanwhile, when the fuel injection valve 134 is in the open state, the valve closing force is released, and thus, the cylinder pressure sensor 140 detects only the pressure in the cylinder 150. Therefore, a pressure difference ΔP corresponding to the valve closing force is generated in the detection result of the cylinder pressure sensor 140 according to opening and closing of the fuel injection valve 134.

In the embodiment, the fuel pressure control unit 90 detects the pressure difference ΔP from the output signal S2 of the cylinder pressure sensor 140, and controls the operation of the pressurizing pump 132 and adjusts the fuel pressure so that the pressure difference ΔP approaches a predetermined target value. As a result, the pressure of the fuel supplied from the pressurizing pump 132 to the fuel injection valve 134 is controlled to be reduced as much as possible within the range of the valve closing force that can ensure oil-tightness. As a result, it is possible to reduce the driving power of the fuel injection valve 134.

The valve closing force may be calculated from the pressure difference ΔP, and the fuel pressure may be adjusted by controlling the operation of the pressurizing pump 132 so that the valve closing force approaches a predetermined target value. For example, it is possible to calculate the valve closing force from the pressure difference ΔP using a calculation formula obtained in advance by calculation or an incident.

Figure 10:
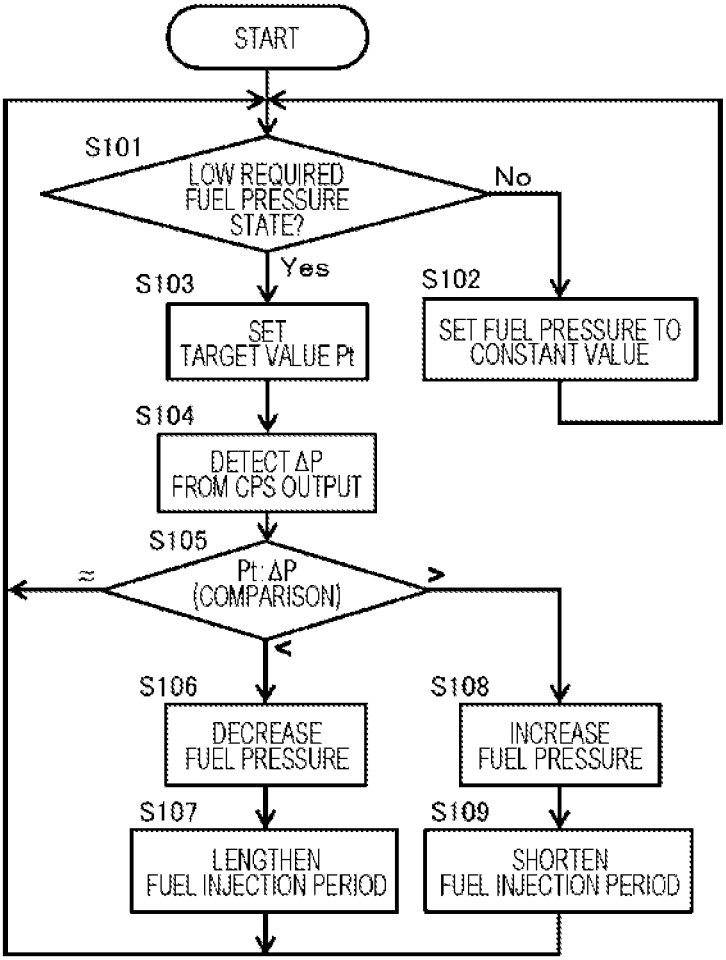
FIG. 10 is a flowchart illustrating a control procedure of a fuel pressure according to the embodiment.

FIG. 10 is a flowchart illustrating a control procedure of the fuel pressure according to the embodiment. The flowchart of FIG. 10 is executed by the control device 1 at predetermined processing cycles when power of the internal combustion engine 100 is turned on.

<<Step S101>>

In Step S101, the fuel pressure control unit 90 determines whether or not the internal combustion engine 100 is in a predetermined low required fuel pressure state. The low required fuel pressure state is a state in which a load of the internal combustion engine 100 is low and a pressure required for the fuel injected by the fuel injection valve 134 is low. In a normal control of the internal combustion engine 100, it is not necessary for the fuel injection valve 134 to inject a fuel at a high pressure in a steady operation state other than at the time of starting or at high output. Therefore, in the embodiment, when the internal combustion engine 100 is in the steady operation state, it is determined that the internal combustion engine 100 is in the low required fuel pressure state, and the fuel pressure is controlled according to the valve closing force.

Figure 11:
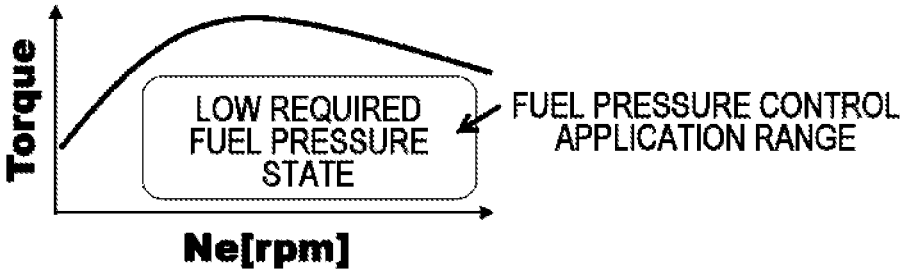
FIG. 11 is a schematic diagram illustrating a low required fuel pressure state.

FIG. 11 is a schematic diagram illustrating the low required fuel pressure state. As illustrated in FIG. 11, when a rotation speed Ne of the internal combustion engine 100 is equal to or more than a predetermined value and a torque is less than a predetermined value, the internal combustion engine 100 is in the low required fuel pressure state, and it is determined that the fuel pressure control is applicable. That is, in Step S101 of FIG. 10, it can be determined whether or not the internal combustion engine 100 is in the low required fuel pressure state based on the rotation speed and the output torque of the internal combustion engine 100. As a result, when it is determined that the internal combustion engine 100 is in the low required fuel pressure state, the process proceeds to Step S103, and when it is determined that the internal combustion engine 100 is not in the low required fuel pressure state, the process proceeds to Step S102.

<<Step S102>>

In Step S102, the fuel pressure control unit 90 controls the operation of the pressurizing pump 132 so that the fuel pressure becomes a constant value. In this case, for example, the fuel pressure control unit 90 sets a target value of the fuel pressure to a predetermined maximum pressure, and outputs the fuel pressure control information S11 according to the target value to the pressurizing pump 132. After executing Step S102, the process returns to Step S101, waits until the next processing cycle, and then continues processing from Step S101.

<<Step S103>>

In Step S103, the fuel pressure control unit 90 sets a target value Pt with respect to the pressure difference ΔP. Here, for example, the target value Pt according to the operating state of the internal combustion engine 100 is set based on the map information stored in advance in the control device 1. The map information used at this time can be determined from prior calculations and experimental results. Further, at this time, the target value Pt to be set may be changed in consideration of a secular change of the fuel injection valve 134 or the cylinder pressure sensor 140. For example, the injection history of the fuel by the fuel injection valve 134 is stored, and when the number of injections (the number of valve closures) reaches a predetermined number, the target value Pt to be set is changed higher than before. In this way, even when the oil-tightness of the fuel injection valve 134 or sensitivity of the cylinder pressure sensor 140 decrease due to the secular change, the pressure of the fuel supplied from the pressurizing pump 132 to the fuel injection valve 134 can be adjusted appropriately.

<<Step S104>>

In Step S104, the fuel pressure control unit 90 detects the pressure difference ΔP from the output signal S2 of the cylinder pressure sensor 140. For example, the output signal S2 of the cylinder pressure sensor 140 at the time when the energization pulse of the valve opening control signal S9 output from the fuel injection control unit 82 is turned on or at the time before this and the output signal S2 of the cylinder pressure sensor 140 at the time when the energization pulse of the valve opening control signal S9 is turned off after a certain period of time has elapsed from that time are acquired.

Then, the pressure difference ΔP is detected by calculating a difference of the acquired output signal S2.

<<Step S105>>

In Step S105, the fuel pressure control unit 90 compares the target value Pt set in Step S103 with the pressure difference ΔP detected in Step S104. As a result, when Pt≈ΔP, that is, when the difference between the target value Pt and the detected pressure difference ΔP is smaller than a predetermined value, the process returns to Step S101, waits until the next processing cycle, and then continues the processing from Step S101.

Meanwhile, as a result of comparing the target value Pt and the pressure difference ΔP in Step S105, when Pt<ΔP, that is, when the detected pressure difference ΔP is larger than the target value Pt, the process proceeds to Step S106. When Pt>ΔP, that is, when the detected pressure difference ΔP is smaller than the target value Pt, the process proceeds to Step S108.

<<Steps S106 and S107>>

In Step S106, the fuel pressure control unit 90 controls the operation of the pressurizing pump 132 so that the fuel pressure decreases. Accordingly, the operation of the pressurizing pump 132 is controlled to adjust the fuel pressure so that the pressure difference ΔP approaches the target value Pt. In the following Step S107, the fuel injection control unit 82 widens a width of the energization pulse of the valve opening control signal S9 to control the fuel injection valve 134 so that a fuel injection period, that is, a period from opening to closing of the fuel injection hole formed in the orifice cup 1345 in the fuel injection valve 134 is lengthened. Therefore, the valve closing force is reduced without changing the fuel injection amount. After executing Step S107, the process returns to Step S101, waits until the next processing cycle, and then continues the processing from Step S101.

<<Steps S108 and S109>>

In Step S108, the fuel pressure control unit 90 controls the operation of the pressurizing pump 132 so as to increase the fuel pressure. Accordingly, the operation of the pressurizing pump 132 is controlled to adjust the fuel pressure so that the pressure difference ΔP approaches the target value Pt. In the following Step S109, the fuel injection control unit 82 narrows the width of the energization pulse of the valve opening control signal S9 to control the fuel injection valve 134 so that the fuel injection period, that is, the period from opening to closing of the fuel injection hole formed in the orifice cup 1345 in the fuel injection valve 134 is shortened. Accordingly, the valve closing force is increased without changing the fuel injection amount. After executing Step S109, the process returns to Step S101, waits until the next processing cycle, and then continues the processing from Step S101.

According to the embodiment described above, the following operational effects are exhibited.

(1) The control device 1 for an internal combustion engine includes the fuel pressure control unit 90 that controls the pressure of the fuel supplied to the fuel injection valve 134 that injects the fuel into the internal combustion engine 100. The fuel injection valve 134 includes the plunger rod 1346 which is the valve body, the solenoid coil 1353 which is the drive unit for driving the plunger rod 1346, and the orifice cup 1345 in which the fuel injection hole opened and closed according to the drive of the plunger rod 1346 is formed. The cylinder pressure sensor 140 that detects the in-cylinder pressure which is a pressure in the combustion chamber of the internal combustion engine 100 is attached to the internal combustion engine 100. The fuel pressure control unit 90 controls the pressure of the fuel based on the pressure difference ΔP between the in-cylinder pressure detected by the cylinder pressure sensor 140 before the plunger rod 1346 is separated from the seat portion of the orifice cup 1345 which is the valve seat and the in-cylinder pressure detected by the cylinder pressure sensor 140 when the plunger rod 1346 is separated from the seat portion of the orifice cup 1345. Therefore, the pressure of the fuel can be appropriately adjusted according to the valve closing force of the fuel injection valve 134.

(2) The fuel pressure control unit 90 controls the pressure of the fuel so that the pressure difference ΔP approaches the predetermined target value Pt (Steps S105 to S109). Therefore, the pressure of the fuel can be reliably adjusted according to the valve closing force of the fuel injection valve 134.

(3) The fuel pressure control unit 90 may change the target value Pt according to the injection history of the fuel by the fuel injection valve 134 (Step S103). Accordingly, the pressure of the fuel can be appropriately adjusted in consideration of the secular change of the fuel injection valve 134 or the cylinder pressure sensor 140.

(4) The pressurizing pump 132 that pressurizes the fuel is attached to the internal combustion engine 100. The fuel pressure control unit 90 controls the operation of the pressurizing pump 132 to control the pressure of the fuel. Accordingly, the pressure of the fuel can be reliably controlled.

(5) The control device 1 for an internal combustion engine further includes the fuel injection control unit 82 that controls the fuel injection valve 134. The fuel injection control unit 82 changes the opening/closing period of the fuel injection hole according to the control result of the pressure of the fuel by the fuel pressure control unit 90 (Steps S107 and S109). Accordingly, the pressure of the fuel can be adjusted without changing the fuel injection amount.

(6) The fuel pressure control unit 90 determines whether or not the internal combustion engine 100 is in the predetermined low required fuel pressure state based on the rotation speed and output torque of the internal combustion engine 100 (Step S101), and when it is determined that the internal combustion engine 100 is not in the predetermined low required fuel pressure state (Step S101: No), the fuel pressure control unit 90 does not control the pressure of the fuel based on the pressure difference ΔP (Step S102). Accordingly, the pressure of the fuel can be adjusted according to the valve closing force of the fuel injection valve 134 without adversely affecting the operation of the internal combustion engine 100.

(7) In the fuel injection valve 134, the fuel injection hole is disposed in the combustion chamber of the internal combustion engine 100.

The cylinder pressure sensor 140 includes the diaphragm 1411 which is the pressure receiving unit disposed closer to the combustion chamber than the fuel injection hole, and the pressure detection element 1412 which is the pressure detecting unit that detects the pressure received by the diaphragm 1411 as the in-cylinder pressure. Accordingly, the cylinder pressure sensor 140 can detect the valve closing force of the fuel injection valve 134 as the pressure difference ΔP.

(8) The fuel pressure control unit 90 controls the pressure of the fuel inside the fuel pipe 133 disposed between the fuel tank 130 for storing the fuel and the fuel injection valve 134. Accordingly, the pressure of the fuel supplied to the fuel injection valve 134 can be appropriately adjusted according to the valve closing force of the fuel injection valve 134.

In the embodiment described above, the example in which the cylinder pressure sensor 140 is provided at the tip of the fuel injection valve 134 has been described. However, the disposition of the cylinder pressure sensor 140 is not limited to this. The cylinder pressure sensor 140 can be disposed at any position as long as the combustion pressure (in-cylinder pressure) of the internal combustion engine 100 can be appropriately measured and the pressure difference ΔP according to the valve closing force of the fuel injection valve 134 can be reliably measured. Further, the cylinder pressure sensor 140 and the fuel injection valve 134 do not have to be integrated with each other, and the cylinder pressure sensor 140 and the fuel injection valve 134 can be disposed in the internal combustion engine 100 as separate configurations.

In the embodiment described above, each functional configuration of the control device 1 described in FIG. 2 may be realized by software executed by the MPU 50 as described above, or may be realized by hardware such as a Field-Programmable Gate Array (FPGA). In addition, these may be mixed and used.

Heretofore, an example of the embodiment of the present invention is described. However, the present invention may be a combination of all the above-described embodiments, or any combination of any two or more embodiments is preferable.

Further, the present invention is not limited to those including all the configurations of the above-described embodiments, and some configurations of the above-described embodiments are replaced with the configurations of other embodiments. Alternatively, the configuration of the above-described embodiment may be replaced with configurations of other embodiments.

In addition, some configurations of the above-described embodiments may be added, deleted, or replaced with the configurations of other embodiments.

The embodiment and various modification examples described above are merely examples, and the present invention is not limited to these contents unless the characteristics of the invention are impaired. Moreover, although various embodiments and modification examples are described above, the present invention is not limited to these contents. Other modes considered within a scope of a technical idea of the present invention are also included in the scope of the present invention.

REFERENCE SIGNS LIST

1 control device
5*a* intake camshaft
5*b* exhaust camshaft
6*a* intake valve
6*b* exhaust valve
10 analog input unit
20 digital input unit
30 A/D converter
40 RAM
50 MPU
60 ROM
70 I/O port
80, 80*a* output circuit
81 overall control unit
82 fuel injection control unit
83 ignition control unit
84 cylinder determination unit
85 angle information generation unit
86 rotation speed information generation unit
87 intake amount measurement unit
88 load information generation unit

89 water temperature measurement unit
90 fuel pressure control unit
91 fuel pressure measurement unit
100 internal combustion engine
110 air cleaner
111 intake pipe
112 intake manifold
113 throttle valve
113*a* throttle opening sensor
114 flow rate sensor
115 intake air temperature sensor
116 intake pressure sensor
120 ring gear
121 crank angle sensor
122 water temperature sensor
123 crankshaft
125 accelerator pedal
126 accelerator position sensor
130 fuel tank
131 feed pump
132 pressurizing pump
133 fuel pipe
134 fuel injection valve
135 fuel pressure sensor
140 cylinder pressure sensor
150 cylinder
160 exhaust manifold
161 three-way catalyst
162 upstream-side air-fuel ratio sensor
163 downstream-side air-fuel ratio sensor
164 exhaust temperature sensor
170 piston
180 cylinder head
200 spark plug
300 ignition coil
500 pump drive cam
1321 suction valve
1322 pressurizing chamber
1323 plunger
1324 tappet
1325 pressing spring
1326 discharge valve
1331 common rail
1341 tolerance ring
1342 nozzle holder
1343 core
1344 housing
1345 orifice cup
1346 plunger rod
1347 anchor
1348 upstream rod guide
1349 downstream rod guide
1350 chip seal
1351 spring
1352 adjuster pin
1353 solenoid coil
1354 O-ring
1355 backup ring
1356 filter
1357 wire
1411 diaphragm
1412 pressure detection element
1413 wire
1414 charge amplifier
1415 terminal

The invention claimed is:

1. A control device for an internal combustion engine comprising:

a fuel pressure control unit that controls a pressure of a fuel supplied to a fuel injection valve that injects the fuel to an internal combustion engine, wherein the fuel injection valve has a valve body, a drive unit that drives the valve body, and a fuel injection hole that is opened or closed according to drive of the valve body, a cylinder pressure sensor that detects an in-cylinder pressure which is a pressure in a combustion chamber of the internal combustion engine is attached to the internal combustion engine, and the fuel pressure control unit controls the pressure of the fuel based on a pressure difference between the in-cylinder pressure detected by the cylinder pressure sensor before the valve body is separated from a valve seat and the in-cylinder pressure detected by the cylinder pressure sensor when the valve body is separated from the valve seat.

2. The control device for an internal combustion engine according to claim 1, wherein the fuel pressure control unit controls the pressure of the fuel so that the pressure difference approaches a predetermined target value.

3. The control device for an internal combustion engine according to claim 2, wherein the fuel pressure control unit changes the target value according to an injection history of the fuel by the fuel injection valve.

4. The control device for an internal combustion engine according to claim 1, wherein a pressurizing pump that pressurizes the fuel is attached to the internal combustion engine, and the fuel pressure control unit controls an operation of the pressurizing pump to control the pressure of the fuel.

5. The control device for an internal combustion engine according to claim 1, further comprising a fuel injection control unit that controls the fuel injection valve, wherein the fuel injection control unit changes an opening/closing period of the fuel injection hole according to a control result of the pressure of the fuel by the fuel pressure control unit.

6. The control device for an internal combustion engine according to claim 1, wherein the fuel pressure control unit determines whether or not the internal combustion engine is in a predetermined low required fuel pressure state based on rotation speed and output torque of the internal combustion engine, and when it is determined that the internal combustion engine is not in the low required fuel pressure state, the fuel pressure control unit does not control the pressure of the fuel based on the pressure difference.

7. The control device for an internal combustion engine according to claim 1, wherein in the fuel injection valve, the fuel injection hole is disposed in a combustion chamber of the internal combustion engine, and the cylinder pressure sensor includes a pressure receiving unit that is disposed closer to the combustion chamber than the fuel injection hole and a pressure detecting unit that detects a pressure received by the pressure receiving unit as the in-cylinder pressure.

8. The control device for an internal combustion engine according to claim 1, wherein the fuel pressure control unit controls the pressure of the fuel inside a fuel pipe disposed between a fuel tank for storing the fuel and the fuel injection valve.

* * * * *